US011815090B2

(12) United States Patent
Cho et al.

(10) Patent No.: US 11,815,090 B2
(45) Date of Patent: Nov. 14, 2023

(54) SCROLL COMPRESSOR

(71) Applicant: Samsung Electronics Co., Ltd., Suwon-si (KR)

(72) Inventors: Sunghea Cho, Suwon-si (KR); Junghoon Park, Suwon-si (KR); Jongcheun Seo, Suwon-si (KR); Namkyu Cho, Suwon-si (KR); Dohyun Kim, Suwon-si (KR); Junguk Jun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 267 days.

(21) Appl. No.: 17/199,267

(22) Filed: Mar. 11, 2021

(65) Prior Publication Data

US 2021/0285444 A1 Sep. 16, 2021

(30) Foreign Application Priority Data

Mar. 12, 2020 (KR) ..... 10-2020-0030630
May 13, 2020 (KR) ..... 10-2020-0057262

(51) Int. Cl.
*F04C 15/00* (2006.01)
*F04C 2/02* (2006.01)

(52) U.S. Cl.
CPC ..... *F04C 15/0007* (2013.01); *F04C 2/025* (2013.01); *F04C 2240/30* (2013.01)

(58) Field of Classification Search
CPC .. F04C 15/0007; F04C 18/0215; F04C 2/025; F04C 2240/30; F04C 27/008
See application file for complete search history.

(56) References Cited

U.S. PATENT DOCUMENTS 5,660,539 A 8/1997 Matsunaga et al.
9,394,904 B2 7/2016 Moon et al.
(Continued)

FOREIGN PATENT DOCUMENTS

JP H08-121366 A 5/1996
JP 2001-227482 A 8/2001
JP 3241575 B2 12/2001
(Continued)

OTHER PUBLICATIONS

English Translation of WO 2016124111 A1 (Year: 2016).*
(Continued)

*Primary Examiner* — Anthony Ayala Delgado

(57) ABSTRACT

Provided is a scroll compressor with enhanced sealing structure of a back pressure chamber. The scroll compressor includes a housing, a fixed scroll fixed to inside of the housing and including a fixed wrap, an orbit scroll including an orbit wrap which forms a compression chamber together with the fixed wrap, a back pressure chamber formed at a frame supporting the orbit scroll, and accommodating refrigerant for pressurizing the orbit scroll to a direction of the fixed scroll, and a sealing ring arranged between the fixed scroll and the orbit scroll to prevent the refrigerant in the back pressure chamber from flowing in or out through a gap between the fixed scroll and the orbit scroll, wherein the sealing ring includes a cut portion cut for the sealing ring to be deformable in a circumferential direction.

18 Claims, 8 Drawing Sheets

(56) References Cited

U.S. PATENT DOCUMENTS

| | | | | |
|---|---|---|---|---|
| 2009/0246059 | A1* | 10/2009 | Nakamura | F04C 27/009 418/55.4 |
| 2011/0158838 | A1 | 6/2011 | Nishide | |

FOREIGN PATENT DOCUMENTS

| | | | | | |
|---|---|---|---|---|---|
| JP | 2003176794 | A | * | 6/2003 | |
| JP | 2007239630 | A | | 9/2007 | |
| JP | 3991170 | B2 | | 10/2007 | |
| JP | 2008-111385 | A | | 5/2008 | |
| JP | 5494136 | B2 | | 5/2014 | |
| KR | 10-0306485 | B1 | | 5/2002 | |
| KR | 10-2010-0104196 | A | | 9/2010 | |
| KR | 10-2011-0064663 | A | | 6/2011 | |
| KR | 10-1238203 | B1 | | 3/2013 | |
| KR | 10-1970529 | B1 | | 4/2019 | |
| KR | 10-2070286 | B1 | | 1/2020 | |
| WO | WO-2016124111 | A1 | * | 8/2016 | F01C 17/066 |

OTHER PUBLICATIONS

English Translation of JP 2003176794 A (Year: 2003).*
International Search Report of the International Searching Authority in connection with International Application No. PCT/KR2021/002891 dated Jun. 24, 2021, 3 pages.

* cited by examiner

SCROLL COMPRESSOR

CROSS-REFERENCE TO RELATED APPLICATION

This application is based on and claims priority under 35 U. S. C. § 119 to Korean Patent Application No. 10-2020-0030630 filed on Mar. 12, 2020 and Korean Patent Application No. 10-2020-0057262 filed on May 13, 2020, the disclosures of which are incorporated herein by reference in their entirety.

BACKGROUND

1. Field

The disclosure relates to a scroll compressor, and more particularly, to a scroll compressor with enhanced sealing structure of a back pressure chamber.

2. Discussion of Related Art

A scroll compressor is a kind of compressor that includes a fixed scroll having a fixed wrap, and an orbiting scroll having an orbiting wrap that matches the fixed wrap, for forming a compression chamber consecutively moving between the fixed wrap and the orbiting wrap to suck in and compress refrigerant while the orbiting scroll orbits the fixed scroll.

As the scroll compressor performs suction, compression, and discharging successively, the scroll compressor is better than other types of compressors in terms of vibration and noise occurring in operation.

When the scroll compressor is operating in an operating region with low compression ratios, however, back pressure in a back pressure chamber that pressurizes the orbiting scroll to make the orbiting scroll and the fixed scroll closely contact each other may be reduced and become unstable. This may lead to failure of maintaining the state of close contact between the orbiting scroll and the fixed control, so stability of the orbiting scroll and the fixed scroll may be reduced.

SUMMARY

According to an aspect of the disclosure, a scroll compressor includes a housing, a fixed scroll fixed to inside of the housing and including a fixed wrap, an orbit scroll including an orbit wrap which forms a compression chamber together with the fixed wrap, a back pressure chamber formed at a frame supporting the orbit scroll, and accommodating refrigerant for pressurizing the orbit scroll to a direction of the fixed scroll, and a sealing ring arranged between the fixed scroll and the orbit scroll to prevent the refrigerant in the back pressure chamber from flowing in or out through a gap between the fixed scroll and the orbit scroll, wherein the sealing ring includes a cut portion cut for the sealing ring to be deformable in a circumferential direction.

The sealing ring may include a first cut portion and a second cut portion cut separated in the cut portion, and the first cut portion may include a separated surface separated from the second cut portion in the circumferential direction.

The fixed scroll may include a scroll ring groove formed for the sealing ring to be inserted to the scroll ring groove, and the sealing ring may be arranged in the scroll ring groove and closely contacts the orbit scroll.

The compression chamber may be arranged on an inner side of the sealing ring, and a portion of the back pressure chamber may be arranged on an outer side of the sealing ring.

When the refrigerant flows out from the back pressure chamber to the compression chamber, a separated distance between the separated surface and the second cut portion and a diameter of the sealing ring may decrease, and the sealing ring may come into close contact with an inner surface of the scroll ring groove.

When the refrigerant flows into the back pressure chamber from the compression chamber, a separated distance between the separated surface and the second cut portion and a diameter of the sealing ring may increase, and the sealing ring may come into close contact with an outer surface of the scroll ring groove.

The first cut portion may further include a contact surface which slides to contact the second cut portion.

The contact surface may have a slope from a surface of the sealing ring.

The sealing ring may be a first sealing ring, and the scroll compressor may further include a second sealing ring arranged between the frame and the orbit scroll to prevent refrigerant from flowing in or out of the back pressure chamber through a gap between the frame and the orbit scroll, and the second sealing ring may include a cut portion cut for the second sealing ring to be deformable in a circumferential direction.

The frame may include a frame ring groove formed for the second sealing ring to be inserted to the frame ring groove, and the second sealing ring may be inserted to the frame ring groove and closely contacts the orbit scroll.

The orbit scroll may include a plate on which the orbit wrap is formed, and the plate may be arranged between the scroll ring groove and the frame ring groove.

The first sealing ring may closely contact a top surface of the plate and the second sealing ring may closely contact a bottom surface of the plate, to prevent refrigerant from flowing into or out of the back pressure chamber.

The first sealing ring may be deformed in the circumferential direction to closely contact an outer surface or inner surface of the scroll ring groove, and the second sealing ring may be deformed in the circumferential direction to closely contact an outer surface or inner surface of the frame ring groove.

The sealing ring may be formed of a non-metallic material.

The first cut portion and the second cut portion may be formed to be symmetrical. According to another aspect of the disclosure, a scroll compressor includes a housing, a fixed scroll fixed to inside of the housing, a frame coupled to the fixed scroll, an orbit scroll arranged between the fixed scroll and the frame, a back pressure chamber arranged between the orbit scroll and the frame, and a first sealing ring arranged between the fixed scroll and the orbit scroll and a second sealing ring arranged between the frame and the orbit scroll, to seal the back pressure chamber.

The first sealing ring and the second sealing ring may have a portion cut for a diameter of the first or second sealing ring to be changed.

The orbit scroll may include a plate contacting the fixed scroll and the frame, the first sealing ring may closely contact a top surface of the plate, and the second sealing ring may closely contact a bottom surface of the plate.

The first sealing ring may be arranged in a scroll ring groove formed at the fixed scroll and having a bottom side covered by the plate, and the second sealing ring may be arranged in a frame ring groove formed at the frame and having a top side covered by the plate.

The first sealing ring may closely contact an outer surface or inner surface of the scroll ring groove as a diameter of the first sealing ring is changed, and the second sealing ring may closely contact an outer surface or inner surface of the frame ring groove as a diameter of the second sealing ring is changed.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
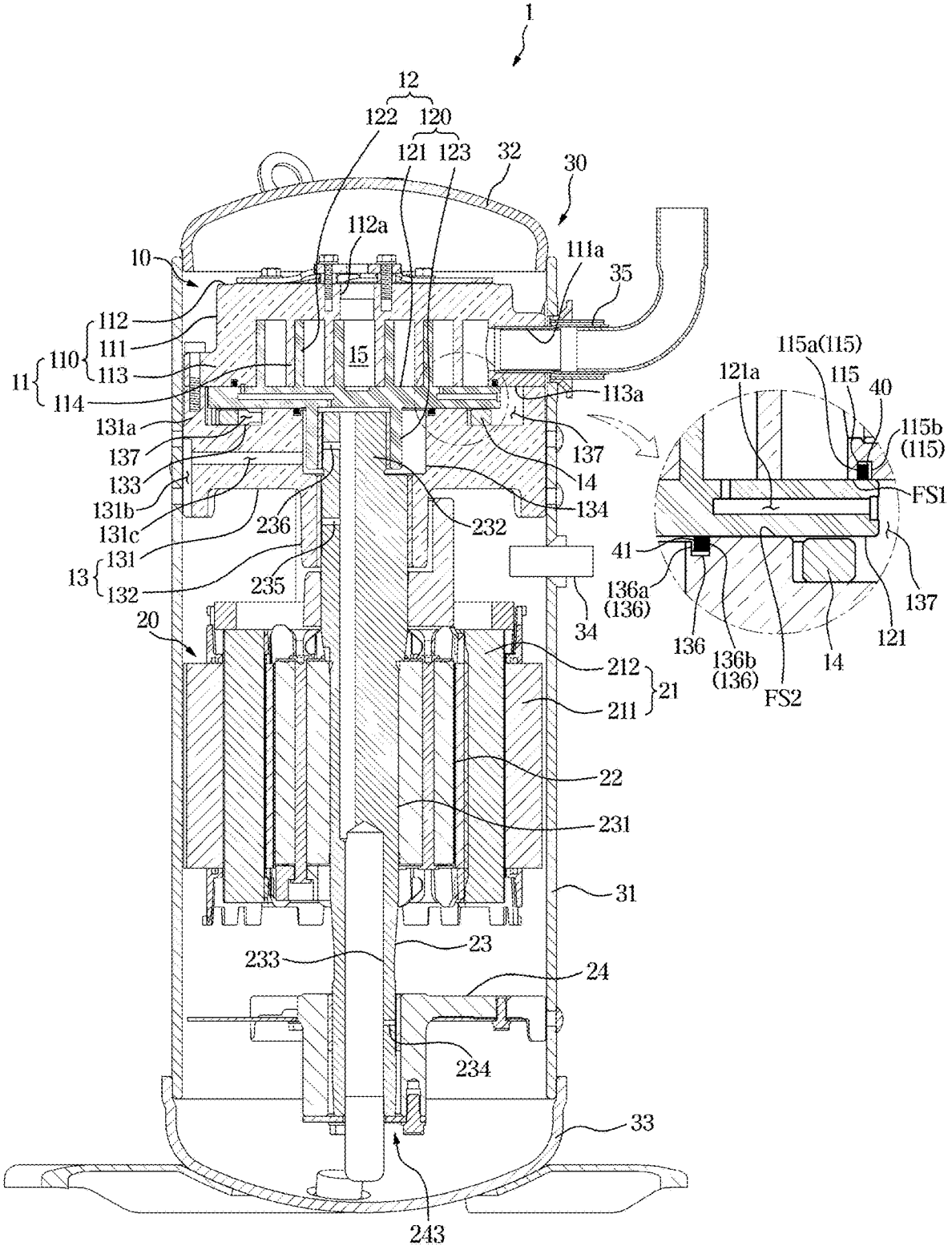
FIG. 1 is an axial cross-sectional view of a scroll compressor and an enlarged view of a portion of the cross-sectional view according to various embodiments of the disclosure.

FIGS. 1 through 8, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments and features as described and illustrated in the disclosure are merely examples, and there may be various modifications replacing the embodiments and drawings at the time of filing this application.

Throughout the drawings, like reference numerals refer to like parts or components. For the sake of clarity, the elements of the drawings are drawn with exaggerated forms and sizes.

The terminology used herein is for the purpose of describing particular embodiments only and is not intended to limit the present disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or room discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms "upper", "lower", "top", and "bottom" as herein used are defined with respect to the drawings, but the terms may not restrict the shape and position of the respective components.

Reference will now be made in detail to embodiments of the disclosure, which are illustrated in the accompanying drawings, wherein like reference numerals refer to the like elements throughout.

Figure 2:
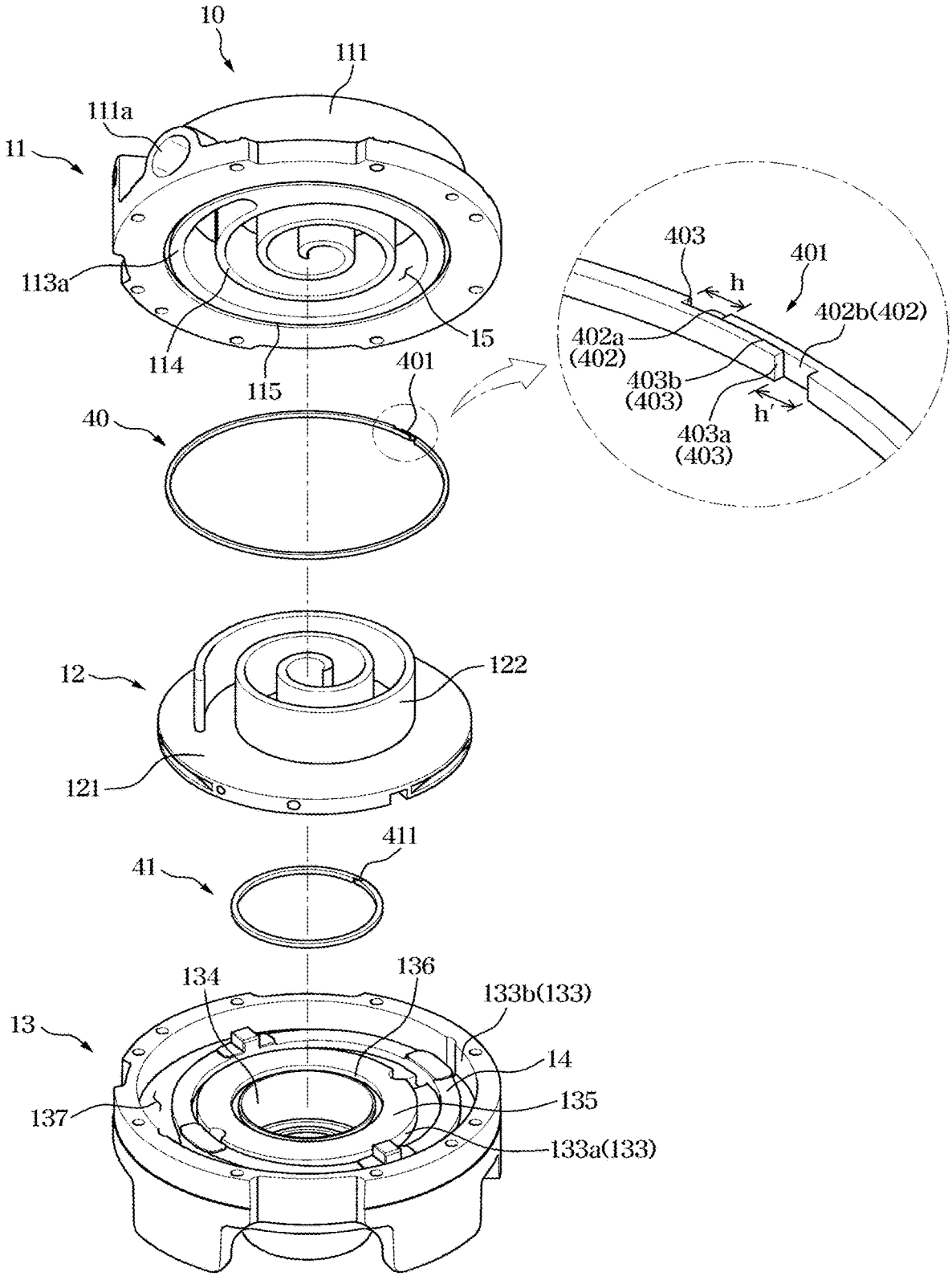
FIG. 2 is an exploded view of a compression part of a scroll compressor and an enlarged view of a portion of the exploded view according to various embodiments of the disclosure.

FIG. 1 is an axial cross-sectional view of a scroll compressor and an enlarged view of a portion of the cross-sectional view according to an embodiment of the disclosure. FIG. 2 is an exploded view of a compression part of a scroll compressor and an enlarged view of a portion of the exploded view.

A scroll compressor 1 is a device widely used for air conditioners, refrigerators, and pumps. In FIG. 1, a vertical cross-sectional view of the closed type scroll compressor 1 used for a refrigerant circuit of an air conditioner is shown.

Referring to FIGS. 1 and 2, the scroll compressor 1 may include a compressing part 10 for compressing refrigerant, a driving motor 20 for driving the compressing part 10, and a housing 30 for accommodating the compressing part 10 and the driving motor 20.

The housing 30 may include a middle casing 31 having a cylindrical shape, and a top casing 32 and a bottom casing 33 mounted on the top and the bottom of the middle casing 31, respectively, for sealing the interior of the housing 30. Furthermore, the housing 30 may include a suction part 35 arranged to suck in refrigerant from outside of the housing 30, and a discharging part 34 arranged to discharge the refrigerant out of the housing 30 after the refrigerant sucked in by the suction part 35 is compressed.

The compression part 10 may include a fixed scroll 11 fixed in the housing 30, an orbit scroll 12 interlocked with and orbiting the fixed scroll 11, a frame 13 fixed to the housing 30 and coupled to the fixed scroll 11, and supporting the orbit scroll 12, and an Oldham ring 14 for making the orbit scroll 12 orbit around but not rotate.

The fixed scroll 11 may include a fixed scroll body 110, and a fixed wrap 114 formed to protrude from the fixed scroll body 110. The fixed wrap 114 may be formed to protrude downwards from a fixed scroll body 110. The fixed wrap 114 may be integrally formed with the fixed scroll body 110.

The fixed scroll body 110 may include a body part 111 having a cylindrical shape, a first plate 112 covering a top opening of the body part 111, and a projection 113 protruding from the bottom end of the body part 111 outwards in a radial direction. A bottom surface 113*a* of the projection 113 may correspond to the bottom surface of the fixed scroll body 110. The body part 111, the first plate 112, and the projection 113 may be integrally formed.

A first bearing surface FS1 may be formed between the bottom surface 113*a* of the projection 113 and a top surface of a second plate 121 of the orbit scroll 12, which come into contact with each other when the orbit scroll 12 makes an orbiting motion. In other words, the first bearing surface FS1 may be formed by contact between the bottom surface 113*a* of the projection 113 and the top surface of the second plate 121 of the orbit scroll 12. An orbiting motion of the second plate 121 may keep changing the position of the first bearing surface FS1 on the bottom surface 113*a* of the projection 113. As the bottom surface 113*a* of the projection 113 and the top surface of the second plate 121 of the orbit scroll 12 may come into contact with each other for the refrigerant to be moved, the refrigerant may be moved across the first bearing surface FS1.

The fixed wrap 114 may be formed to protrude downwards from the bottom end of the first plate 112. The fixed wrap 114 may be arranged in a spiral form when viewed from below. A material of the fixed scroll 11 may be cast iron, e.g., gray cast iron such as FC250.

A through hole 111*a* may be formed on the body part 111 in a radial direction. The through hole 111*a* may be linked to the suction part 35. The through hole 111*a* may serve as a suction port to suck the refrigerant into a space enclosed by the body part 111, the first plate 112, and the orbit scroll 12.

A through hole 112*a* may be formed in a center portion of the first plate in the vertical direction. The through hole 112*a* may serve as a discharging port to discharge the refrigerant from a space enclosed by the first plate 112, the fixed wrap 114, and the orbit scroll 12.

The fixed scroll 11 may be fixed to the frame 13 by a position settling part such as a bolt or a position settling pin, which passes through a vertical through hole (not shown) formed at the projection 113.

The orbit scroll 12 may include an orbit scroll body 120, and an orbit wrap 122 formed to protrude from the orbit scroll body 120 to form a compression chamber 15 when interlocked with the fixed wrap 114 of the fixed scroll 11. The orbit scroll 12 may be placed between the fixed scroll 11 and the frame 13. The orbit scroll body 120 and the orbit wrap 122 may be integrally formed.

The orbit scroll body 120 may include the second plate 121 having the shape of a disc, and a body part 123 having the shape of a cylinder protruding downwards from a bottom end of the second plate 121. The orbit wrap 122 may protrude upwards from a top end of the second plate 121.

The orbit wrap 122 may be formed to protrude upwards from the orbit scroll body 120. The orbit wrap 122 may be arranged in a spiral form when viewed from above. A material of the orbit scroll 12 may be FC or FCD, for example.

The orbit wrap 122 of the orbit scroll 12 may be interlocked with the fixed wrap 114 of the fixed scroll 11. The orbit wrap 122 of the orbit scroll 12 and the fixed wrap 114 of the fixed scroll 11 may be arranged in a space formed between the body part 111 of the fixed scroll 11, the first plate 112, and the second plate 121 to form the compartmental compression chamber 15. When the orbit wrap 122 is operated to orbit the fixed wrap 114, the volume of the compression chamber 15 may be reduced, enabling the refrigerant to be compressed. Specifically, an internal space between the fixed wrap 114 and the orbit wrap 122 may contract toward the rotation center and compress the refrigerant.

An eccentric shaft 232, which will be described later, of a rotational shaft 23 is inserted to the body part 123 of the orbit scroll 12 through a slide bearing. As such, the body part 123 may serve as a bearing for the eccentric shaft 232.

The frame 13 may include a first body part 131 having the shape of a cylinder, and a second body part 132 having the shape of a cylinder protruding downwards from the bottom surface of the first body part 131. The outer circumferential surface of the first body part 131 may be fixed to the middle casing 31. The rotational shaft 23, which will be described later, of the driving motor 20 may be put into inner sides of the first body part 131 and the second body part 132 through a journal bearing. As such, the frame 13 may serve as a bearing that rotationally supports the rotational shaft 23.

A projection 131*a* may be formed on an outer circumferential portion of the first body part 131 to protrude upwards from the top end of the first body part 131. A female screw may be formed at the projection 131*a*, and a bolt passing through the through hole formed at the projection 113 of the fixed scroll 11 is fastened with the female screw so that the fixed scroll 11 may be coupled with the frame 13. It is not, however, limited thereto, and the frame 13 and the fixed scroll 11 may be coupled with each other by other parts.

A first recess 133 and a second recess 134 may be formed to be sunken down from the top surface of the first body part 131. The second recess 134 may be formed in a center portion of the first body part 131, and the first recess 133 may be formed in a ring shape between the second recess 134 and the projection 131*a*.

A top surface of the first body part 131 between the first recess 133 and the second recess 134 may form a second bearing surface FS2 together with the bottom surface of the second plate 121 to support the orbiting orbit scroll 12.

Specifically, a supporting surface 135, which is a top surface of a stepped portion between the first recess 133 and the second recess 134, may connect between an inner surface 133*a* of the first recess 133 and a side surface of the second recess 134 and form the second bearing surface FS2 together with the bottom surface of the second plate 121. In other words, the second bearing surface FS2 may be formed by contact between the supporting surface 135 and the bottom surface of the second plate 121. As the supporting surface 135 and the bottom surface of the second plate 121 may come into contact with each other for the refrigerant to be moved, the refrigerant may be moved across the second bearing surface FS2. The second bearing surface FS2 may be formed in a ring shape.

The body part 123 of the orbit scroll 12 may be inserted to the second recess 134. The Oldham ring 14 may be arranged in the first recess 133 between the frame 13 and the orbit scroll 12 to prevent rotation of the orbit scroll 12.

A groove 131*b* extending in the vertical direction may be formed on an outer circumferential portion of the first body part 131. A linkage path 131*c* connecting the inside of the second recess to the groove 131*b* in the radial direction may be formed in the first body part 131. Accordingly, the inside of the second recess 134 may be linked to an outside space of the frame 13 through the groove 131*b* and the linkage path 131*c*.

The rotational shaft 23 is fitted inside and coupled to the inner circumferential surface of the second body part 132 through a journal bearing, and the second body part 132 may serve as a bearing for rotationally supporting the rotational shaft 23.

A discharge path (not shown) may be formed in the compression part 10 to discharge the refrigerant compressed by the fixed scroll 11 and the orbit scroll 12. The discharge path may have an end connected to the through hole 112*a* of the first plate 112, through which to discharge the refrigerant from the space enclosed by the fixed scroll 11 and the orbit scroll 12, and the other end connected to a space located farther down than the frame 13 in the housing 30.

The driving motor 20 may be located under the compression part 10 and fixed to the housing 30.

The driving motor 20 may include a stator 21, a rotor 22, the rotational shaft 23 which supports the rotor 22 and rotates against the housing 30, and a supporting member 24 rotationally supporting the rotational shaft 23.

The stator 21 may include a stator body 211, and a coil 212 wound around the stator body 211.

The stator body 211 may be a layered body in which multiple electric steel sheets are layered, and may be schematically shaped like a cylinder. The stator body 211 may be forcedly fitted and fixed to the inside of the middle casing 31. It is not, however, limited thereto, and there may be another way of fixing the stator body 211 to the housing 30.

The stator body 211 may include a plurality of teeth (not shown) on a portion of the inner side of the stator body 211, which faces the outer circumferential surface of the rotor 22, in the circumferential direction. The coil 212 is arranged in slots (not shown) existing between the neighboring teeth. As for the stator 21 in the embodiment of the disclosure, the coil 212 may have a type of, for example, concentrated winding, in which the coil 212 is put in the slots existing between the neighboring teeth.

The rotor 22 may be a layered body in which multiple ring-shaped electric steel sheets are layered, and have a cylindrical form altogether. The rotor 22 may be forcedly fitted around the rotational shaft 23. The rotor 22 is fixed to the rotational shaft 23 and rotated along with the rotational shaft 23. A permanent magnet, for example, may be buried inside of the rotor 22.

An outer diameter of the rotor 22 may be smaller than an inner diameter of the stator body 211 of the stator 21, so there may be a gap between the rotor 22 and the stator 21.

The rotational shaft 23 may include a main shaft 231 coupled with the rotor 22, and the eccentric shaft 232 installed above the main shaft 231 and center of which is one-sided from the center of the main shaft 231.

The main shaft 231 may have a lower portion rotationally supported by the supporting member 24, and an upper portion rotationally supported by the frame 13 of the compression part 10. The supporting member 24 may serve as a bearing for rotationally supporting the rotational shaft 23. The eccentric shaft 232 may be rotationally supported by the body part 123 of the orbit scroll 12.

The rotational shaft 23 may include a through hole flow path 233 that bores through the rotational shaft 23 in the axial direction. In the rotational shaft 23, a first linkage path 234 connecting the through hole flow path 233 to a bearing of the supporting member 24, a second linkage path 235 connecting the through hole flow path 233 to a bearing of the frame 13, and a third linkage path 236 connecting the through hole flow path 233 to a bearing of the body part 123 of the orbit scroll 12 may be formed in the radial direction.

A pump 243 may be mounted at a bottom portion of the supporting member 24 for pumping up lubricant. A hole (not shown) or a groove (not shown) may be formed at the supporting member 24 for connecting between an upper portion and a lower portion of the supporting member 24 by boring through the supporting member 24.

Operation of the scroll compressor 1 will now be described.

When the driving motor 20 of the scroll compressor 1 is driven, the rotational shaft 23 may be rotated, and the orbit scroll 12 fitted around the eccentric shaft 232 of the rotational shaft 23 may orbit the fixed scroll 11. When the orbit scroll orbits the fixed scroll 11, a low-pressure refrigerant may be sucked into the space enclosed by the fixed scroll 11 and the orbit scroll 12 from outside of the housing 30 through the suction part 35. The refrigerant sucked in is compressed depending on a change in volume of the compression chamber 15. A high-pressure refrigerant compressed in the compression chamber 15 may flow out through the bottom of the compression part 10.

The high-pressure refrigerant flowing out through the bottom of the compression part 10 may be discharged out of the housing 30 through the discharging part 34. On the way out of the housing 30, the refrigerant may pass through a space between the rotor 22 and the stator 21 or a space between the stator 21 and the middle casing 31. The high-pressure refrigerant discharged out of the housing 30 may be sucked in back through the suction part 35 after undergoing the cycle of condensing, expansion, and evaporation in the refrigerant circuit.

In the meantime, the lubricant collected in the bottom casing 33 of the housing 30 is pumped up by the pump 243 and rises along the through hole flow path 233 formed in the rotational shaft 23. The risen lubricant is supplied to the respective bearings of the rotational shaft 23 through the first linkage path 234, the second linkage path 235, and the third linkage path 236 formed in the rotational shaft 23, or supplied to the bearing surfaces FS1 and FS2 of the compression part 10. The lubricant supplied to the bearing surfaces FS1 and FS2 of the compression part 10 or the lubricant supplied to the bearings of the rotational shaft 23 through the second linkage path and the third linkage path 236 returns to the bottom casing 33 through the linkage path 131*c* and the groove 131*b* formed at the frame 13, the space between the rotor 22 and the stator 21, an axial hole formed at the supporting member 24, or the like, and is collected in the bottom of the housing 30. In this process and in a process that the high-pressure refrigerant passes through a space between the rotor 22 and the stator 21 before being discharged out of the housing 30, the lubricant and the refrigerant flow to a low-pressure side while cooling the driving motor 20. The lubricant flowing along with the high-pressure refrigerant is then separated from the refrigerant and collected in the bottom of the housing 30.

In the meantime, as for the operation of the scroll compressor 1, a back pressure chamber 137 may be provided for the orbit scroll 12 to make an orbiting motion while closely contacting the fixed scroll 11. As the back pressure chamber pressurizes the orbit scroll 12 to a direction of the fixed scroll 11, the orbit scroll 12 and the fixed scroll 11 may come into close contact with each other, minimizing vibration or trembling of the orbit scroll 12 and the fixed scroll 11 during the operation of the scroll compressor 1 and minimizing the refrigerant of the compression chamber 15 flowing out of the compression chamber 15.

Hence, for stable operation of the scroll compressor 1, pressure inside the back pressure chamber 137 needs to be kept in a stable state. Specifically, the pressure created by the refrigerant accommodated in the back pressure chamber 137 (hereinafter, referred to as back pressure) may pressurize the orbit scroll 12 to the direction of the fixed scroll 11, and the back pressure needs to remain constant.

In a case, in particular, that the scroll compressor 1 is operated in an operating region with low compression ratios, the back pressure in the back pressure chamber 137 may be reduced and unstable, so that the state of close contact between the orbit scroll 12 and the wrap scroll 11 may not be maintained well. Operating in the operating region with low compression ratios may be defined as operating the scroll compressor 1 at the compression ratio of 1.4 or less.

When the refrigerant flows out of the back pressure chamber 137 having had a constant back pressure, the back pressure may drop, or when an outside refrigerant flows into the back pressure chamber 137, the back pressure may increase, so that the back pressure in the back pressure chamber 137 may be in an unstable state in which the back pressure constantly changes rather than a stable state at a constant pressure level. To prevent or minimize such a situation where the refrigerant of the back pressure chamber 137 flows in or out unintentionally, the scroll compressor 1 may include at least one sealing ring 40 and 41 arranged at the compression part 10.

Figure 3:
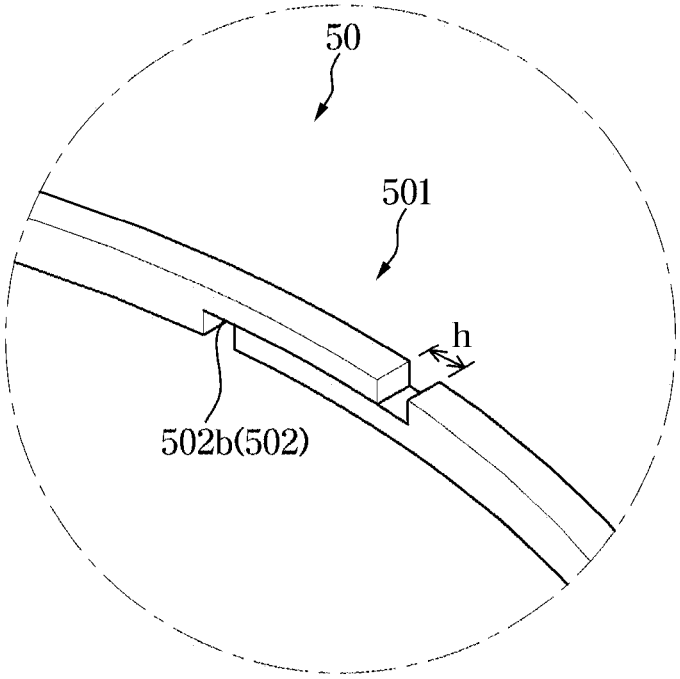
FIG. 3 is an enlarged view of a portion of a sealing ring of a scroll compressor according to various embodiments of the disclosure.
Figure 4:
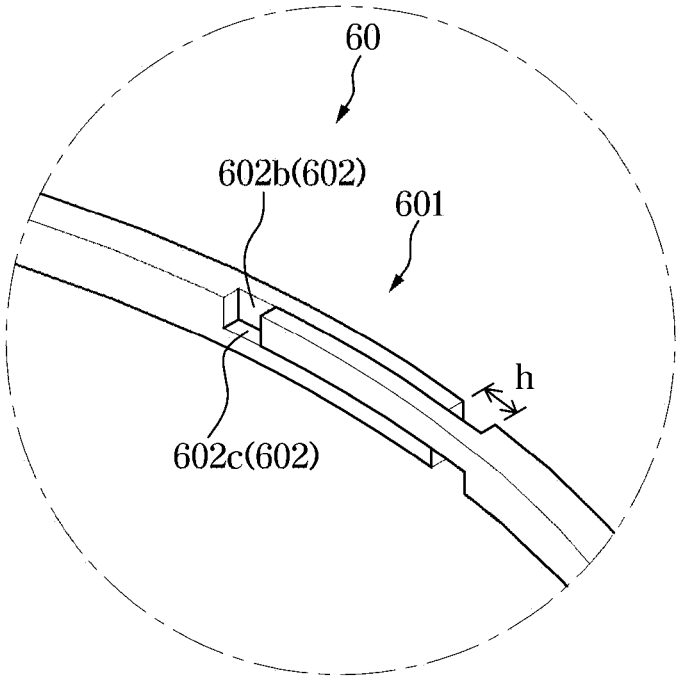
FIG. 4 is an enlarged view of a portion of a sealing ring of a scroll compressor according to various embodiments of the disclosure.
Figure 5:
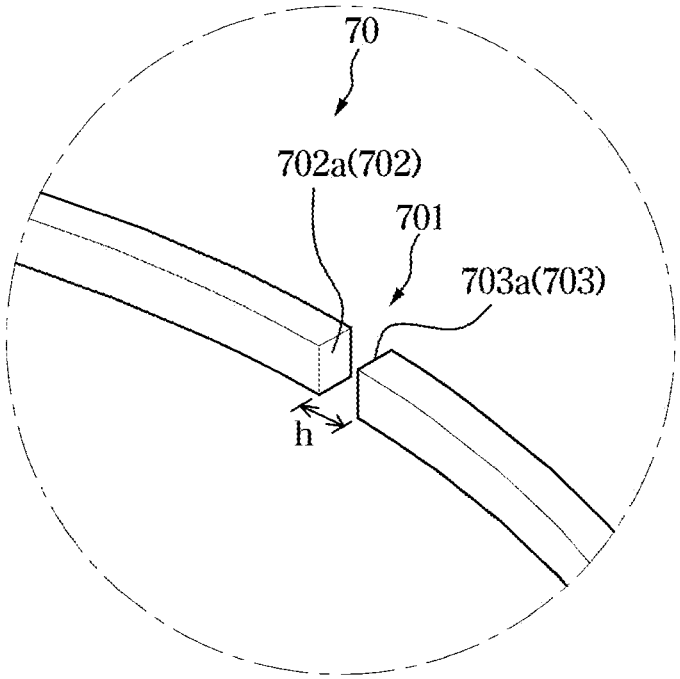
FIG. 5 is an enlarged view of a portion of a sealing ring of a scroll compressor according to various embodiments of the disclosure.
Figure 6:
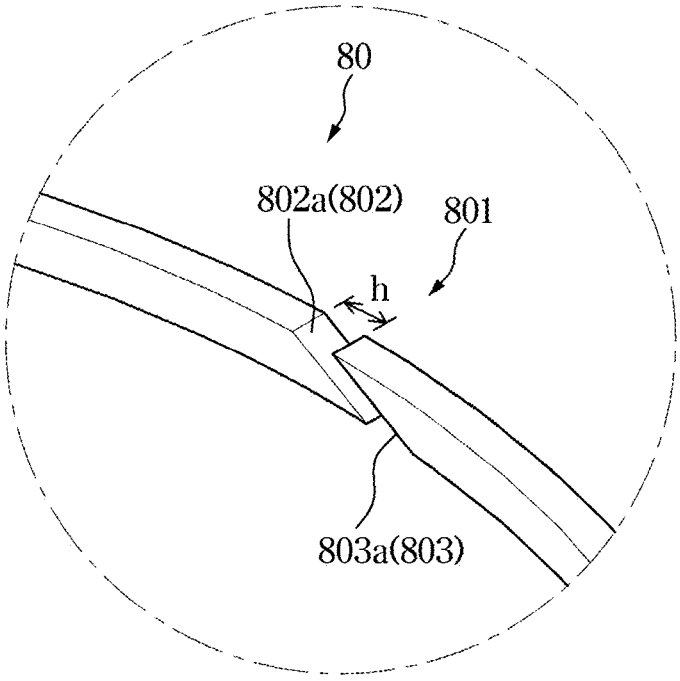
FIG. 6 is an enlarged view of a portion of a sealing ring of a scroll compressor according to various embodiments of the disclosure.
Figure 7:
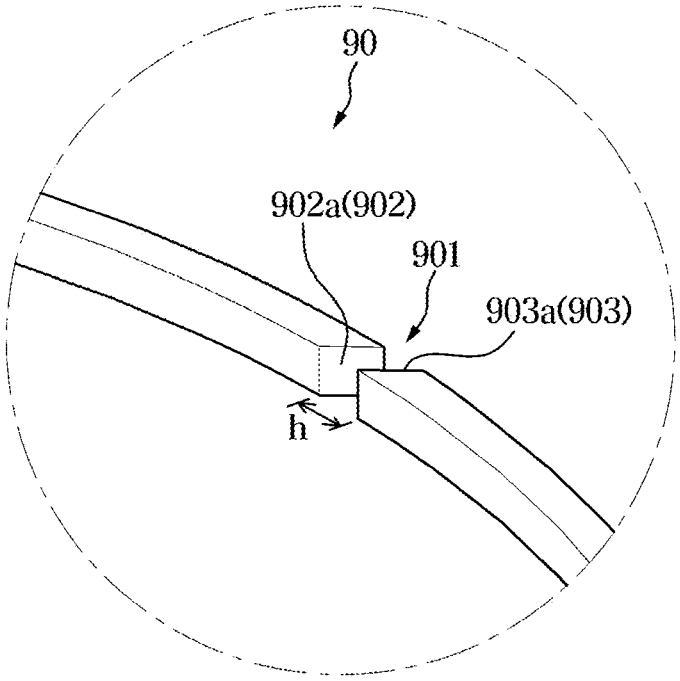
FIG. 7 is an enlarged view of a portion of a sealing ring of a scroll compressor according to various embodiments of the disclosure.
Figure 8:
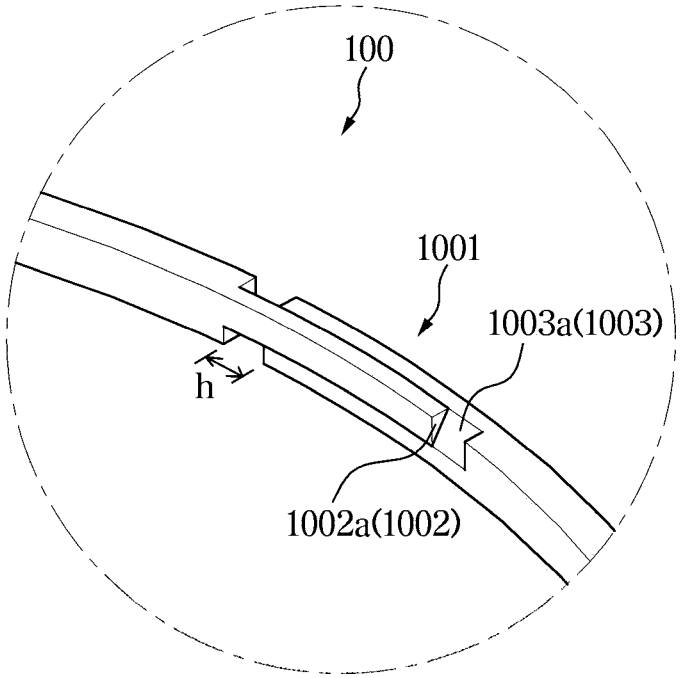
FIG. 8 is an enlarged view of a portion of a sealing ring of a scroll compressor according to various embodiments of the disclosure.

FIG. 3 is an enlarged view of a portion of a sealing ring of a scroll compressor, according to an embodiment of the disclosure. FIG. 4 is an enlarged view of a portion of a sealing ring of a scroll compressor, according to another embodiment of the disclosure; FIG. 5 is an enlarged view of a portion of a sealing ring of a scroll compressor, according to another embodiment of the disclosure. FIG. 6 is an enlarged view of a portion of a sealing ring of a scroll compressor, according to another embodiment of the disclosure. FIG. 7 is an enlarged view of a portion of a sealing ring of a scroll compressor, according to another embodiment of the disclosure. FIG. 8 is an enlarged view of a portion of a sealing ring of a scroll compressor, according to another embodiment of the disclosure.

Referring to FIGS. 1 to 8, the compression part 10 including the at least one sealing ring 40 and 41 will now be described in detail.

The compression part 10 may include the back pressure chamber 137. The back pressure chamber 137 may be arranged in the first recess 133 formed on the frame 13. The back pressure chamber 137 may correspond to a space between the first recess 133 and the second plate 121.

Specifically, the back pressure chamber 137 may correspond to a space enclosed by the first recess 133, the second plate 121, and the fixed scroll 11. A surface of the fixed scroll 11 that covers the back pressure chamber 137 may correspond to the bottom surface 113*a* of the projection 113 that forms the first bearing surface FS1 together with the top surface of the second plate 121 making an orbiting motion.

Specifically, the back pressure chamber 137 may be formed by being enclosed by the inner surface 133*a* of the first recess 133, the outer surface 133*b* of the first recess 133, the bottom surface of the first recess 133, the bottom surface of the second plate 121, a side surface of the second plate 121, and the bottom surface 113*a* of the projection 113 of the fixed scroll 11.

The back pressure chamber 137 may accommodate refrigerant to create back pressure. Specifically, the second plate 121 of the orbit scroll 12 may include a linkage path 121*a* linking the compression chamber 15 to the back pressure chamber 137. The refrigerant or a refrigerant mixed with lubricant may move through the linkage path 121*a* to the back pressure chamber 137 where intermediate pressure is formed.

As the bottom surface 113*a* of the projection 113 of the fixed scroll 11, which defines a surface of the back pressure chamber, forms the first bearing surface FS1 together with the top surface of the second plate 121, the back pressure chamber 137 may be linked to the first bearing surface FS1, and may be linked to the second bearing surface FS2 because the inner surface 133*a* of the first recess 133 that defines a side of the back pressure chamber 137 and the supporting surface 135 of the frame 13 are connected.

The scroll compressor 1 may include a first sealing ring 40 arranged to prevent the refrigerant from flowing into or out of the back pressure chamber 137 through the gap between the fixed scroll 11 and the orbit scroll 12. Specifically, the first sealing ring 40 may prevent the refrigerant from flowing into or out of the back pressure chamber 137 through the first bearing surface FS1.

The first sealing ring 40 may be inserted to and arranged in a scroll ring groove 115 formed at the fixed scroll 11.

The scroll ring groove 115 may be formed to be sunken upwards from the bottom surface 113*a* of the projection 113 that defines the first bearing surface FS1. The scroll ring groove 115 may be formed in the shape of a ring having a rectangular cross-section to correspond to the shape of the cross-section of the first sealing ring 40, which will be described later. The bottom of the scroll ring groove 115 is opened, which may be covered by the top surface of the second plate 121.

The first sealing ring 40 may be inserted to the scroll ring groove 115 through the open bottom of the scroll ring groove 115. The first sealing ring 40 in a state of being inserted to the scroll ring groove 115 may closely contact the top surface of the second plate 121, which covers the bottom of the scroll ring groove 115, through the open bottom of the scroll ring groove 115. That is, the first sealing ring 40 may be arranged on the first bearing surface FS1 and may closely contact the top surface of the second plate 121.

The scroll compressor 1 may include a second sealing ring 41 arranged to prevent the refrigerant from flowing into or out of the back pressure chamber 137 through the gap between the frame 13 and the orbit scroll 12. Specifically, the second sealing ring 41 may prevent the refrigerant from flowing into or out of the back pressure chamber 137 through the second bearing surface FS2.

The second sealing ring 41 may be inserted to and arranged in a frame ring groove 136 formed at the frame 13.

The frame ring groove 136 may be formed to be sunken downwards from the supporting surface 135 that defines the second bearing surface FS2. Specifically, the frame ring groove 136 may be located on the inner circumferential side of the supporting surface 135. The frame ring groove 136 may be formed in the shape of a ring having a rectangular cross-section to correspond to the shape of the cross-section of the second sealing ring 41, which will be described later. The top of the frame ring groove 136 is opened, which may be covered by the bottom surface of the second plate 121.

The second sealing ring 41 may be inserted to the frame ring groove 136 through the open top of the frame ring groove 136. The second sealing ring 41 in a state of being inserted to the frame ring groove 136 may closely contact the bottom surface of the second plate 121, which covers the top of the frame ring groove 136, through the open top of the frame ring groove 136. That is, the second sealing ring 41 may be arranged on the second bearing surface FS2 and may closely contact the bottom surface of the second plate 121.

The second plate 121 may be arranged between the scroll ring groove 115 and the frame ring groove 136 for making orbiting motion, and a diameter of the scroll ring groove 115 may be greater than the diameter of the frame ring groove 136.

The first sealing ring 40 may have the shape of a ring with the rectangular cross-section, and may include a cut portion 401 cut for the first sealing ring 40 to be deformed in the circumferential direction. It is not, however, limited thereto, and the first sealing ring 40 may have a differently shaped cross-section.

The first sealing ring 40 may be cut in and divided by the cut portion 401, and may include a first cut portion 402 and a second cut portion 403. The first and second cut portions 402 and 403 may refer to cut planes, which are not exposed without the cut portion 401, newly exposed to the outside at both open ends when the first sealing ring 40 is cut in the cut portion 401. The first and second cut portions 402 and 403 may be symmetrical.

The first cut portion 402 may include a separated side 402*a* separated from the second cut portion 403 in the circumferential direction, and there may be a separated distance h between the separated side 402*a* of the first cut portion and the second cut portion 403. Similarly, the second cut portion 403 may include a separated side 403*a* separated from the first cut portion 402 in the circumferential direction, and there may be a separated distance h' between the separated side 403*a* of the second cut portion and the first cut portion 402. The separated distance h' between the separated side 403*a* of the second cut portion and the first cut portion 402 may be equal in size to the separated distance h between the separated side 402*a* of the first cut portion and the second cut portion 403. A contact surface 403*b*, which will be described later, may be formed on both the first and second cut portions 402 and 403. Although the first cut portion 402 will be focused in the following description, the same may be true of the second cut portion 403.

The first cut portion 402 may include the contact surface 402*b* that may slide to contact the second cut portion 403. The contact surface 403*b* is a contact surface as shown in FIG. 2, which may be formed in parallel with the inner circumferential surface and outer circumferential surface of the first sealing ring 40.

It is not, however, limited thereto. For example, a contact surface 502*b* of a first cut portion 502, which is formed in a cut portion 501 as shown in FIG. 3, may be formed to be parallel to the top surface and bottom surface of the first sealing ring 50. In yet another example, the first contact portion 602 formed in a cut portion 601 as shown in FIG. 4 may include a plurality of contact surfaces 602*b* and 602*c*, which may include the first contact surface 602*b* formed to be parallel to the inner circumferential surface and outer circumferential surface of the first sealing ring 60, and the second contact surface 602*c* formed to be parallel to the top surface and bottom surface of the first sealing ring 60. In yet another example, a first cut portion 1002 and a second cut portion 1003 formed in a cut portion 1001 as shown in FIG. 8 may include a plurality of contact surfaces such as contact surface 1002*a* and contact surface 1003*a*, and the contact surface 1003*a* may be formed to have a slope from the top surface and the inner surface of the first sealing ring 100 and may slide to contact the corresponding contact surface. They are not, however, limited thereto. For example, the contact surface that may slide to contact the corresponding contact surface may be formed to have a slope from the bottom surface and outer surface of the first sealing ring 100. The contact surface 1003*a* may be formed on one of the first cut portion 1002 or the second portion 1003, or on both the first and second cut portions 1002 and 1003 to be symmetrical.

Alternatively, the contact surface may be omitted. As shown in FIG. 5, a first cut portion 702 and a second cut portion 703 formed in a cut portion 701 may include separated surfaces 702*a* and 703*a* without any contact surface, and the separated surface 702*a* of the first cut portion 702 and the separated surface 703*a* of the second cut portion 703 may be formed to be in parallel with the cross-section of the first sealing ring 70 and to face each other. In another example, as shown in FIG. 6, a first cut portion 802 and a second cut portion 803 formed in a cut portion 801 may include separated surfaces 802*a* and 803*a* without any contact surface, and the separated surface 802*a* of the first cut portion 802 and the separated surface 803*a* of the second cut portion 803 may be formed to have a slope from the top and bottom surfaces of the first sealing ring 80 and face each other. In yet another example, as shown in FIG. 7, a first cut portion 902 and a second cut portion 903 formed in a cut portion 901 may include separated surfaces 902*a* and 903*a* without any contact surface, and the separated surface 902*a* of the first cut portion 902 and the separated surface 903*a* of the second cut portion 903 may be formed to have a slope from the inner and outer surfaces of the first sealing ring 90 and face each other.

The first cut portion and the second cut portion formed in the cut portion 411 of the second sealing ring 41 may correspond to a pair of the first and second cut portions in the above examples. The second sealing ring 41 may have the same shape as the first sealing ring 40 although having a different diameter. It is not, however, limited thereto, and the first sealing ring 40 and the second sealing ring 41 may have the first and second cut portions that correspond to different ones of the above examples.

An occasion when the first sealing ring 40 and the second sealing ring 41 are deformed will now be described in detail.

The first bearing surface FS1 may have one side connected to the back pressure chamber 137 and the other side connected to the compression chamber 15 adjacent to the back pressure chamber 137. Pressure in the compression chamber 15 may be higher or less than back pressure in the back pressure chamber 137 depending on operating conditions and states of the scroll compressor 1.

When the pressure in the compression chamber 15 adjacent to the back pressure chamber 137 is higher than the back pressure in the back pressure chamber 137, refrigerant in the compression chamber 15 may flow into the back pressure chamber 137 through the first bearing surface FS1. In this case, the first sealing ring 40 inserted to the scroll ring groove 115 and arranged on the first bearing surface FS1 may have the cut portion 401 split open due to a difference in pressure between inside and outside, increasing the separated distance h and/or h' and the diameter and coming into close contact with the top surface of the second plate 121 and the outer surface 115*b* of the scroll ring groove 115. This may block the refrigerant from flowing into the back pressure chamber 137 through the first bearing surface FS1, and prevent variation in the back pressure in the back pressure chamber 137.

When the pressure in the compression chamber 15 adjacent to the back pressure chamber 137 is less than the back pressure in the back pressure chamber 137, refrigerant in the back pressure chamber 137 may flow out to the compression chamber 15 through the first bearing surface FS1. In this case, the first sealing ring 40 inserted to the scroll ring groove 115 and arranged on the first bearing surface FS1 may have reduced separated distance h and/or h' and diameter and come into close contact with the top surface of the second plate 121 and the inner surface 115*a* of the scroll ring groove 115. This may block the refrigerant flowing out of the back pressure chamber 137 through the first bearing surface FS1, and prevent variation in the back pressure in the back pressure chamber 137.

The second bearing surface FS2 may have one side connected to the back pressure chamber 137 and the other side connected to the second recess 134. Although pressure in the second recess 134 is usually higher than the back pressure in the back pressure chamber 137, it is not limited thereto. For example, on an occasion, the pressure in the second recess 134 may be less than the back pressure in the back pressure chamber 137.

When the pressure in the second recess 134 is higher than the back pressure in the back pressure chamber 137, refrigerant in the second recess 134 may flow into the back pressure chamber 137 through the second bearing surface FS2. In this case, the second sealing ring 41 inserted to the frame ring groove 136 and arranged on the second bearing surface FS2 may have the cut portion 411 split open due to a difference in pressure between inside and outside, increasing the separated distance and the diameter and coming into close contact with the bottom surface of the second plate 121 and the outer surface 136*b* of the frame ring groove 136. This may block the refrigerant from flowing into the back pressure chamber 137 through the second bearing surface FS2, and prevent variation in the back pressure in the back pressure chamber 137.

When the pressure in the second recess 134 is less than the back pressure in the back pressure chamber 137, the refrigerant in the back pressure chamber 137 may flow out into the second recess 134 through the second bearing surface FS2. In this case, the second sealing ring 41 inserted to the frame ring groove 136 and arranged on the second bearing surface FS2 may have reduced separated distance and diameter and come into close contact with the bottom surface of the second plate 121 and the inner surface 136*a* of the frame ring groove 136. This may block the refrigerant flowing out of the back pressure chamber 137 through the second bearing surface FS2, and prevent variation in the back pressure in the back pressure chamber 137.

As described above, the first sealing ring 40 and the second sealing ring 41 may come into close contact with the ring grooves 115 and 136 as the diameters of them change, and thus have better sealing performance as compared with the traditional sealing rings that may have a gap with the ring groove because there is no change in diameter.

According to an embodiment of the disclosure, a scroll compressor with minimized pressure variation of a back pressure chamber may be provided.

According to an embodiment of the disclosure, a scroll compressor including a sealing ring that is deformable in a circumferential direction to efficiently seal the back pressure chamber may be provided.

Although the present disclosure has been described with various embodiments, various changes and modifications may be suggested to one skilled in the art. It is intended that the present disclosure encompass such changes and modifications as fall within the scope of the appended claims.

What is claimed is:

1. A scroll compressor comprising:

a housing;

a fixed scroll fixed to inside of the housing and including a fixed wrap;

an orbit scroll including an orbit wrap which forms a compression chamber together with the fixed wrap;

a back pressure chamber formed at a frame supporting the orbit scroll, and accommodating refrigerant for pressurizing the orbit scroll to a direction of the fixed scroll; and a sealing ring arranged between the fixed scroll and the orbit scroll to prevent the refrigerant in the back pressure chamber from flowing in or out through a gap between the fixed scroll and the orbit scroll, wherein the sealing ring comprises a cut portion cut for the sealing ring to be deformable in a circumferential direction, wherein the fixed scroll comprises a scroll ring groove formed for the sealing ring to be inserted to the scroll ring groove, and wherein the sealing ring is arranged in the scroll ring groove and closely contacts the orbit scroll.

2. The scroll compressor of claim 1, wherein:

the sealing ring comprises a first cut portion and a second cut portion cut and separated in the cut portion, and the first cut portion comprises a separated surface separated from the second cut portion in the circumferential direction.

3. The scroll compressor of claim 2, wherein:

the compression chamber is arranged on an inner side of the sealing ring, and a portion of the back pressure chamber is arranged on an outer side of the sealing ring.

4. The scroll compressor of claim 3, wherein when the refrigerant flows out from the back pressure chamber to the compression chamber, a separated distance between the separated surface and the second cut portion and a diameter of the sealing ring decrease, and the sealing ring comes into close contact with an inner surface of the scroll ring groove.

5. The scroll compressor of claim 3, wherein when the refrigerant flows into the back pressure chamber from the compression chamber, a separated distance between the separated surface and the second cut portion and a diameter of the sealing ring increases, and the sealing ring comes into close contact with an outer surface of the scroll ring groove.

6. The scroll compressor of claim 2, wherein the first cut portion further comprises a contact surface which slides to contact the second cut portion.

7. The scroll compressor of claim 6, wherein the contact surface has a slope from a surface of the sealing ring.

8. The scroll compressor of claim 2, wherein the sealing ring is a first sealing ring, further comprising a second sealing ring arranged between the frame and the orbit scroll to prevent refrigerant from flowing in or out of the back pressure chamber through a gap between the frame and the orbit scroll, wherein the second sealing ring comprises a cut portion cut for the second sealing ring to be deformable in a circumferential direction.

9. The scroll compressor of claim 8, wherein:

the frame comprises a frame ring groove formed for the second sealing ring to be inserted to the frame ring groove, and the second sealing ring is inserted to the frame ring groove and closely contacts the orbit scroll.

10. The scroll compressor of claim 9, wherein:

the orbit scroll comprises a plate on which the orbit wrap is formed, and the plate is arranged between the scroll ring groove and the frame ring groove.

11. The scroll compressor of claim 10, wherein the first sealing ring closely contacts a top surface of the plate and the second sealing ring closely contacts a bottom surface of the plate, to prevent refrigerant from flowing into or out of the back pressure chamber.

12. The scroll compressor of claim 11, wherein the first sealing ring is deformed in the circumferential direction to closely contact an outer surface or inner surface of the scroll ring groove, and the second sealing ring is deformed in the circumferential direction to closely contact an outer surface or inner surface of the frame ring groove.

13. The scroll compressor of claim 1, wherein the sealing ring is formed of a non-metallic material.

14. The scroll compressor of claim 2, wherein the first cut portion and the second cut portion are formed to be symmetrical.

15. A scroll compressor comprising:

a housing;

a fixed scroll fixed to inside of the housing;

a frame coupled to the fixed scroll;

an orbit scroll arranged between the fixed scroll and the frame;

a back pressure chamber arranged between the orbit scroll and the frame; and a first sealing ring arranged between the fixed scroll and the orbit scroll and a second sealing ring arranged between the frame and the orbit scroll, to seal the back pressure chamber, wherein the first sealing ring is arranged in a scroll ring groove formed at the fixed scroll and having a bottom side covered by a plate of the orbit scroll, and wherein the second sealing ring is arranged in a frame ring groove formed at the frame and having a top side covered by the plate.

16. The scroll compressor of claim 15, wherein the first sealing ring and the second sealing ring have a portion cut for a diameter of the first or second sealing ring to be changed.

17. The scroll compressor of claim 16, wherein:

the plate contacts the fixed scroll and the frame, the first sealing ring closely contacts a top surface of the plate, and the second sealing ring closely contacts a bottom surface of the plate.

18. The scroll compressor of claim 17, wherein the first sealing ring closely contacts an outer surface or inner surface of the scroll ring groove as a diameter of the first sealing ring is changed, and the second sealing ring closely contacts an outer surface or inner surface of the frame ring groove as a diameter of the second sealing ring is changed.

* * * * *